United States Patent [19]

Wanamaker

[11] 4,191,151

[45] Mar. 4, 1980

[54] OXYGEN SENSOR SIGNAL PROCESSING CIRCUIT FOR A CLOSED LOOP AIR/FUEL MIXTURE CONTROLLER

[75] Inventor: Joseph L. Wanamaker, Birmingham, Mich.

[73] Assignee: General Motors Corporation, Detroit, Mich.

[21] Appl. No.: 888,247

[22] Filed: Mar. 20, 1978

[51] Int. Cl.[2] ..... F02B 3/00

[52] U.S. Cl. ..... 123/119 EC; 123/32 EA; 123/32 EE

[58] Field of Search ..... 123/119 EC, 32 EA, 119 E, 123/32 EE; 60/276, 285

[56] References Cited

U.S. PATENT DOCUMENTS

| | | | |
|---|---|---|---|
| 3,973,529 | 8/1976 | Wessel et al. | 123/32 EE |
| 4,019,474 | 4/1977 | Nishimiya et al. | 123/32 EE |
| 4,019,474 | 4/1977 | Nishimuya et al. | 60/276 |
| 4,029,061 | 6/1977 | Asano | 123/32 EE |
| 4,088,095 | 5/1978 | Aono | 60/285 |
| 4,116,170 | 9/1978 | Anzai | 60/285 |
| 4,117,815 | 10/1978 | Ikeura | 123/32 EE |
| 4,120,269 | 10/1978 | Fujishiro | 123/32 EE |
| 4,131,089 | 12/1978 | Fujishiro et al. | 60/285 |
| 4,132,200 | 1/1979 | Asano et al. | 60/276 |

FOREIGN PATENT DOCUMENTS

| | | | |
|---|---|---|---|
| 2547142 | 4/1976 | Fed. Rep. of Germany | 123/119 EC |
| 2553679 | 6/1976 | Fed. Rep. of Germany | 123/119 E |
| 2617527 | 11/1976 | Fed. Rep. of Germany | 123/119 EC |

*Primary Examiner*—Charles J. Myhre
*Assistant Examiner*—R. A. Nelli
*Attorney, Agent, or Firm*—Howard N. Conkey

[57] ABSTRACT

A processing circuit for use in an internal combustion engine closed loop air/fuel mixture controller is responsive to the output of an oxygen sensor exposed to the exhaust gas output of the internal combustion engine to provide a signal that indicates the sense of the deviation of the oxidizing/reducing conditions of the engine exhaust gases from a predetermined condition (usually stoichiometry). The processing circuit compares the output signal from the oxygen sensor with a pair of reference levels to provide the signal that indicates the sense of the deviation of the condition of the exhaust gases from the predetermined condition and which is independent of the effects of the absolute levels of the oxygen sensor and independent of the variance between the sensor response to changing air/fuel ratios in one direction and to sensor response to changing air/fuel ratios in the opposite direction.

3 Claims, 5 Drawing Figures

OXYGEN SENSOR SIGNAL PROCESSING CIRCUIT FOR A CLOSED LOOP AIR/FUEL MIXTURE CONTROLLER

This invention is directed toward closed loop air/fuel mixture controllers for internal combustion engines employing a sensor exposed to the exhaust gas output of the engine and particularly toward a processing circuit for processing the output signal of the sensor.

A single catalytic device may be utilized to accomplish both the oxidation and reduction necessary for minimizing the undesirable exhaust components from an internal combustion engine provided that the air/fuel mixture supplied to the engine is maintained within a narrow band near stoichiometry (the mixture wherein the oxygen required to oxidize the hydrocarbons and carbon monoxide is substantially the amount that is required to be removed to reduce the oxides of nitrogen).

The most common method of controlling the air/fuel ratio so as to maintain the mixture of the gases supplied to the converter within the narrow band near stoichiometry to achieve both simultaneous oxidation and reduction generally employs a closed loop controller. In the most common form of these closed loop systems, the air/fuel ratio of the mixture supplied to the internal combustion engine is controlled in response to a sensor that is responsive to the oxidizing/reducing conditions in the exhaust gases. These systems commonly employ a zirconia oxygen sensor, which provides an output signal that shifts rather abruptly between two voltage levels with small changes in the air/fuel ratio around stoichiometry.

The zirconia oxygen sensors generally used provide an output signal at a high voltage level when the air/fuel ratio of the mixture supplied to the internal combustion engine is less than stoichiometry (a rich mixture) and provides a relatively low level voltage signal when the air/fuel ratio of the mixture supplied to the internal combustion engine is greater than stoichiometry (a lean mixture). However, zirconia oxygen sensors are generally affected by such parameters as temperature, age, contamination and measuring circuitry. For example, the voltage levels provided in response to sensed air/fuel ratios greater than and less than stoichiometry vary with age and temperature. Additionally, the zirconia oxygen sensor is also characterized in that its time response to changing oxidizing/reducing conditions in a first direction through stoichiometry varies from its time response to changing oxidizing/reducing conditions in an opposite direction through stoichiometry. For example, the time response of the zirconia oxygen sensor to air/fuel ratios varying from a ratio greater than stoichiometry to a ratio less than stoichiometry is generally faster than the time response when the air/fuel ratio varies from a value less than stoichiometry to a value greater than stoichiometry. In addition the sensor time response may vary with sensor use.

All of the aforementioned sensor characteristics may affect the operation of the closed loop controller in its ability to maintain the air/fuel ratio at the desired value such as stoichiometry. It has been proposed to provide a comparator switch which compares the amplitude of the output signal from the zirconia oxygen sensor with a constant reference level having a value generally between the maximum and minimum values of the output signal and which provides a two-level signal which represents the sense of the deviation of the oxidizing/reducing conditions from stoichiometry. However, in these systems, the aforementioned sensor characteristics may result in the closed loop controller adjusting the air/fuel ratio of the mixture supplied to the engine to a value offset from the desired value.

It is the general object of this invention to provide for an improved circuit for processing the output of an air/fuel ratio sensor in an internal combustion engine air/fuel ratio controller and providing a signal that is substantially independent of certain sensor characteristics.

It is another object of this invention to provide for a circuit for processing the output signal from a sensor sensing the oxidizing/reducing conditions in the exhaust gases of an internal combustion engine and providing a signal indicating the sense of the deviation of the oxidizing/reducing conditions from a predetermined condition and which is substantially independent of the sensor time response characteristics.

It is another object of this invention to provide for a circuit for processing the output signal from a sensor sensing the oxidizing/reducing conditions in the exhaust gases of an internal combustion engine and providing a signal indicating the sense of the deviation of the oxidizing/reducing conditions from a predetermined condition and which is substantially independent of the absolute levels of the sensor output signal and to the sensor time response characteristics.

These and other objects of this invention may be best understood by reference to the following description of a preferred embodiment and the drawings in which.

Figure 1:
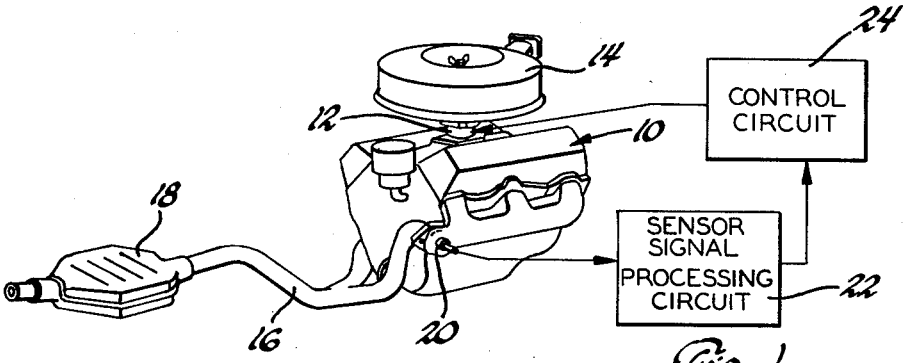
FIG. 1 is a view of an engine with its exhaust system and a general control system employing the principles of this invention for controlling the air/fuel mixture supplied to the engine.

Referring to FIG. 1, an internal combustion engine 10 is supplied with a mixture of fuel and air through appropriate conventional supply means which, in this embodiment, includes a carburetor 12. Fuel is supplied to the carburetor 12 via a conventional fuel container and pump means (not illustrated) and air is supplied to the carburetor 12 via an air cleaner 14. While the illustrated embodiment employs the carburetor 12 for supplying the air/fuel mixture, it is understood that the supply means could employ other known apparatus for delivering an air/fuel mixture to the engine 10. For example, the fuel supply means could embody fuel injection apparatus.

The air/fuel mixture supplied to the engine 10 forms a combustible mixture drawn into the respective cylinders and burned, thereby producing energy that is utilized, for example, in propelling an automobile. The combustion by-products from the engine 10 are exhausted through an exhaust conduit 16 which includes a catalytic converter 18. After flowing through the catalytic converter 18, the exhaust gases are discharged into the atmosphere.

The catalytic converter 18 is of the three-way type wherein carbon monoxide, hydrocarbons and nitrogen oxides can be simultaneously converted if the air/fuel mixture supplied thereto is maintained within a narrow band at stoichiometry, the ratio containing fuel and oxygen in such proportions that, in perfect combustion, both would be completely consumed. If the air/fuel ratio deviates from the narrow band at stoichiometry, the converter conversion efficiency of at least one of the undesirable exhaust constituents decreases.

In some instances, such as during periods of cold-engine operation, engine deceleration and engine power demand, it may be desired to operate the engine 10 at an air/fuel ratio different from stoichiometry. However, it will be assumed in the following description for illustrating the invention that stoichiometry control is desired so as to provide for a maximum conversion of all three of the aforementioned exhaust gas constituents.

The carburetor 12 is generally calibrated so as to supply an air/fuel mixture to the engine 10 at stoichiometry. However, it is difficult to provide an air/fuel delivery means, such as the carburetor 12, which has the desired response to the fuel determining input parameters over the full range of engine operating conditions. Additionally, these systems are generally incapable of compensating for the various ambient conditions and fuel variations, particularly to the degree required in order to maintain the air/fuel mixture within the required narrow range at stoichiometry. Consequently, the air/fuel ratio provided by the carburetor 12 in response to its fuel determining input parameters may deviate from stoichiometry during engine operation.

To provide for the control of the air/fuel ratio of the mixture supplied by the carburetor 12 to the engine 10 so as to obtain the desired converter conversion characteristics over all of the engine operating conditions, an oxygen sensor 20 is provided for sensing the oxidizing/reducing condition of the exhaust gases upstream from the catalytic converter 18. As illustrated in FIG. 1, the oxygen sensor 20 is positioned at the discharge point of one of the exhaust manifolds of the engine 10 and senses the exhaust discharge therefrom. The sensor 20 is preferably of the zirconia type which, when exposed to engine exhaust gases at high temperatures, e.g., 700° F., generates an output voltage which changes abruptly as the air/fuel ratio of the exhaust gases passes through the stoichiometric air/fuel ratio. Such sensors are well known in the art, a typical example being that illustrated in the U.S. Pat. No. 3,844,920 to Burgett et al, dated Oct. 29, 1974.

Figure 2:
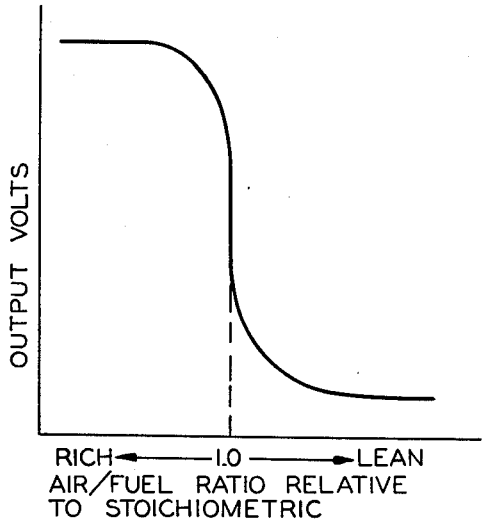
FIG. 2 is a graph illustrating a typical output signal of the air/fuel ratio sensor of FIG. 1.

FIG. 2 illustrates the output voltage of the oxygen sensor 20 as a function of the air/fuel ratio supplied by the carburetor 12. It can be seen that the voltage output of the sensor 20 achieves its maximum value with rich air/fuel mixtures and its minimum value when the sensor is exposed to lean air/fuel mixtures. Further, the output voltage from the sensor 20 exhibits an abrupt change between the high and low voltage values as the air/fuel ratio of the mixture passes through stoichiometry.

The oxygen sensor 20 is generally characterized in that its time response to an air/fuel ratio varying from a value greater than stoichiometry to a value less than stoichiometry (lean to rich excursion) is faster than the time response to an air/fuel ratio varying from a value less than stoichiometry to a value greater than stoichiometry (rich to lean excursion). Further, this difference in time response to changing air/fuel ratios in one direction from the time response to changing air/fuel ratios in the other direction may vary as a function of parameters including sensor aging. The sensor 20 is also characterized in that the maximum and minimum values may vary as a function of parameters including temperature and age.

The output of the oxygen sensor 20 is coupled to the input of a signal processing circuit 22 which incorporates the principles of this invention and which provides an output signal indicating the sense of the deviation of the air/fuel ratio from stoichiometry and which is independent of the aforementioned sensor characteristics. The output of the processing circuit 22 is coupled to a control circuit 24 which generates a control signal in response to the output of the signal processing circuit 22 and which varies in amount and sense tending to restore the air/fuel ratio of the mixture supplied to the engine 10 by the carburetor 12 to stoichiometry. The control circuit 24 may take the form of a proportional plus integral control circuit such as illustrated in application Ser. No. 838,629, filed on October 3, 1977. If the control circuit 24 includes both proportional plus integral terms, its output control signal in response to the two-level output of the sensor signal processing circuit 22 takes the form of a step (proportional) plus ramp (integral) function that adjusts the carburetor 12 in a sense tending to restore the stoichiometric air/fuel ratio.

The carburetor 12 includes an air/fuel ratio adjustment device that is responsive to the control signal output of the control circuit 24 to adjust the air/fuel ratio of the mixture supplied to the engine 10. One such device is illustrated in application Ser. No. 801,061, filed on May 27, 1977.

Figure 3:
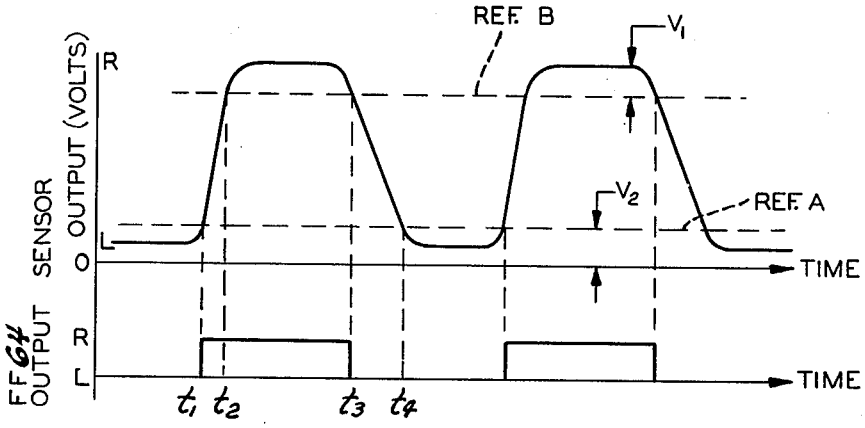
FIG. 3 is a graph illustrating the output of the oxygen sensor of FIG. 1 and the sensor signal processing circuit in accordance with the principles of this invention.

Due to the engine transport delay which is the time between the supplying of an air/fuel mixture to the engine 10 and the sensing of the resulting air/fuel ratio by the oxygen sensor 20, the proportional plus integral control term output of the control circuit 24 causes the air/fuel ratio in the carburetor 12 to overshoot the stoichiometric air/fuel ratio by an amount determined by the transport delay time, the proportional step and the rate of change of the integral term of the control signal. Consequently, the air/fuel ratio of the mixture supplied to the engine 10 has an average value equal to stoichiometry but which oscillates around stoichiometry with the amplitude and frequency of the oscillation being determined by the time constant of the control circuit 24 and the transport delay. FIG. 3 illustrates the output of the oxygen sensor 20 over two complete cycles of oscillation of the fuel control system. This FIGURE illustrates the sensor condition wherein the response of the oxygen sensor 20 when responding to a lean-to-rich transition of the air/fuel ratio relative to stoichiometry is faster than its time response when responding to a rich-to-lean transition of the air/fuel ratio relative to stoichiometry. This characteristic in conjunction with conventional sensor signal processing circuits would generally result in the control circuit 24 controlling the carburetor 12 so as to supply an air/fuel ratio which is offset from stoichiometry in the lean direction. For example, if the oxygen sensor processing circuit were of the conventional form employing a comparator switch which compares the output of the oxygen sensor with a constant reference level substantially intermediate the upper and lower voltage levels of the output signal of the oxygen sensor 20, the resulting two-level output of the comparator switch when the air/fuel ratio is at stoichiometry would indicate a time relationship between rich and lean indications wherein the duration of the rich indication would exceed the duration of the lean indication even though the actual time duration that the air/fuel ratio is greater than stoichiometry is equal to the time duration that the air/fuel ratio is less than stoichiometry. Consequently, the integral term output of the control circuit 24 would adjust the average air/fuel ratio to a value greater than stoichiometry and until a point is reached wherein the processing circuit output represents the time duration of the rich excursions equaling the time durations of the lean excursions.

The sensor signal processing circuit 22 of this invention provides a two-level output signal representing the sense of the deviation of the air/fuel ratio from stoichiometry and which is independent of the variances of the rich-to-lean and lean-to-rich time responses of the sensor 20 and to the amplitude variations of the sensor signal saturation levels so as to provide a more precise control of the air/fuel ratio at stoichiometry by the control circuit 24. In this respect, the signal processing circuit 22 employs a pair of reference voltage levels with which the output of the sensor 20 is compared. The output state of the sensor signal processing circuit 22 is controlled in accordance with the relationship of the sensor output signal relative to these two reference levels in a manner such that the output indication is substantially independent of the aforementioned sensor characteristics.

Figure 4:
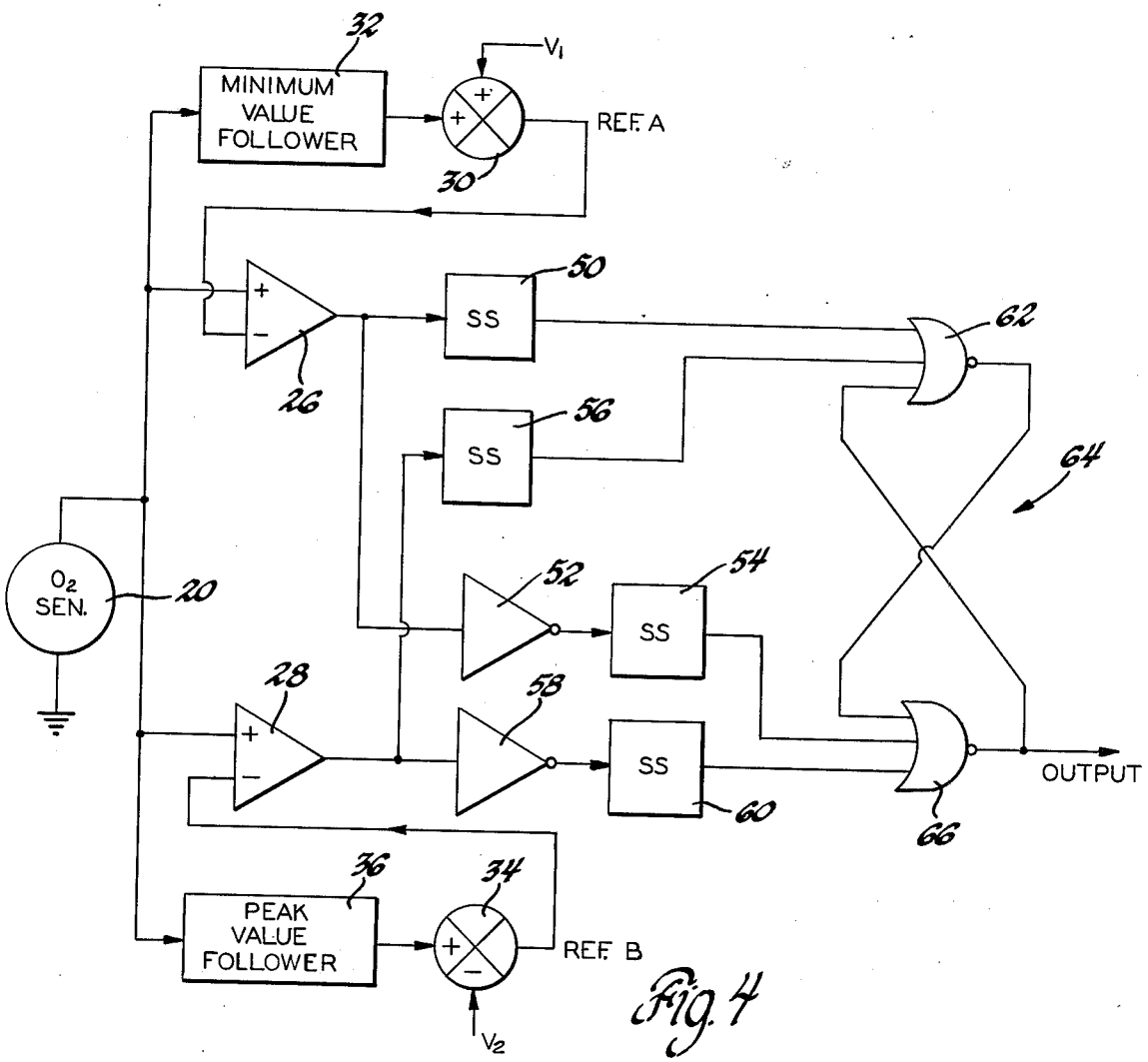
FIG. 4 is a schematic diagram of the sensor signal processing circuit of FIG. 1 illustrating the principles of this invention.

Referring to FIG. 4, the voltage signal output of the oxygen sensor 20 is coupled to the positive input of each of a pair of comparator switches 26 and 28. The comparator switch 26 compares the oxygen sensor signal with a low reference value A that is greater than the minimum value of the oxygen sensor signal by an amount that is equal to or greater than the noise margin of the oxygen sensor signal. The comparator switch 28 compares the oxygen sensor signal with a high reference value B that is less than the maximum value of the oxygen sensor signal by an amount that is equal to or greater than the noise margin of the oxygen sensor signal.

Since the maximum and minimum values of the oxygen sensor signal may vary as a function of temperature, age, etc., the reference values A and B are varied in response to sensed minimum and maximum values of the oxygen sensor signal. The value of reference A is generated by adding a constant value $V_1$ and the minimum value of the oxygen sensor output signal, as provided by a minimum value follower 32, in a summer 30. The value of $V_1$ is greater than the noise margin of the oxygen sensor signal and may have a value, for example, within the range between 50 and 100 millivolts. The value of reference B is generated by subtracting a constant value $V_2$ from the maximum value of the oxygen sensor signal, as provided by a peak value follower 36, in a summer 34. The value of $V_2$ is greater than the noise margin of the oxygen sensor signal and may have a value, for example, within the range between 50 and 100 millivolts.

Figure 5:
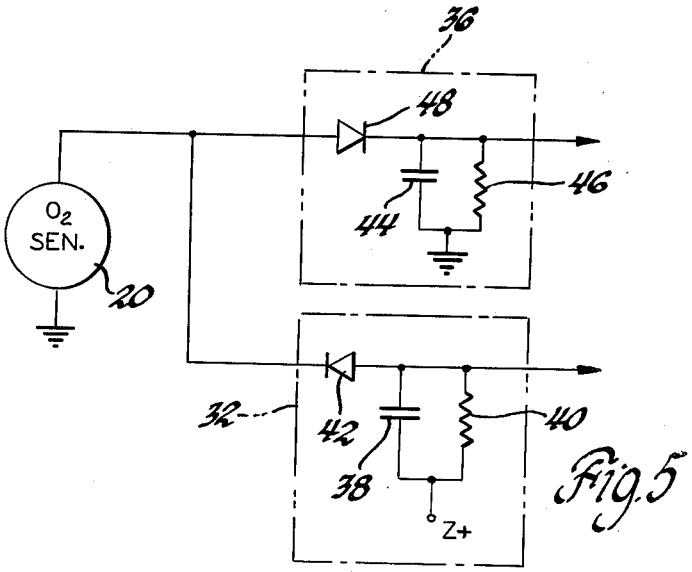
FIG. 5 is a schematic diagram illustrating a minimum and a peak value follower used in the circuit of FIG. 4.

The followers 32 and 36 may take the form of the circuit illustrated in FIG. 5. The minimum value follower 32 includes a capacitor 38 coupled in parallel with a resistor 40 with the parallel combination being coupled between a positive voltage source Z+ and the anode of a diode 42. The cathode of the diode 42 is coupled to the output of the oxygen sensor 20. The voltage on the capacitor 38 at the anode of the diode 42 tracks the minimum value of the output of the oxygen sensor 20. The time constant of the minimum value follower 32 is determined by the values of the capacitor 38 and the resistor 40.

The peak value follower 36 includes a capacitor 44 parallel coupled with a resistor 46, the parallel combination being coupled between ground potential and the cathode of a diode 48. The anode of the diode 48 is coupled to the output of the oxygen sensor 20. The potential on the capacitor at the cathode of the diode 48 tracks the peak value of the output signal from the oxygen sensor 20. The time constant of the peak value follower 36 is determined by the values of the capacitor 44 and the resistor 46.

Referring again to FIG. 4, the output of the comparator switch 26 is coupled to the input of a single shot multivibrator 50 and to the input of an inverter 52. The output of the inverter 52 is coupled to the input of a single shot multivibrator 54.

The output of the comparator switch 28 is coupled to the input of a single shot multivibrator 56 and to the input of an inverter 58. The output of the inverter 58 is coupled to the input of a single shot multivibrator 60.

The multivibrators 50, 54, 56 and 60 are conventional in form and provide digital logic 1 pulses (positive voltage pulses) when triggered by the negative to positive transition of the voltage signal applied to their inputs. The outputs of the single shot multivibrators 50 and 56 are coupled to respective inputs of a digital logic NOR gate 62 in a set-reset flip-flop 64, the inputs to the NOR gate 62 comprising the set inputs. The outputs of the single shot multivibrators 54 and 60 are coupled to respective inputs of a digital logic NOR gate 66 in the flip-flop 64, which inputs comprise the reset inputs of the flip-flop. The NOR gates 62 and 66 are cross coupled to form the flip-flop function. The output of the NOR gate 66 comprises the output of the sensor signal processing circuit 22 of FIG. 1.

The operation of the circuit of FIG. 4 will be described assuming the following initial conditions: the flip-flop 64 is reset such that the output of the NOR gate 66 is a digital logic zero level (substantially ground potential), the air/fuel ratio is greater than stoichiometry so that the output of the sensor 20 is at its lower saturation voltage level, and the output of the single shot multivibrators 50, 54, 56 and 60 are all at a digital logic 0 level.

The control circuit 24 of FIG. 1 responds to the low level output of the flip-flop 64 to cause the carburetor 12 to decrease the air/fuel ratio of the mixture supplied to the engine 10 in ramp fashion toward a stoichiometric air/fuel ratio. When the ratio passes through stoichiometry and after the engine transport delay, the output of the oxygen sensor 20 increases from its low level saturation voltage to its high level saturation voltage as illustrated in FIG. 3a. The time required for this transition is determined by the rate of change in the control of the air/fuel ratio by the control circuit 24 and the time response of the oxygen sensor 20. A short time after the transition begins and at time $t_1$, the output voltage signal from the oxygen sensor 20 becomes greater than the reference level A and the output of the comparator switch 26 shifts from a low value to a high value to trigger the single-shot mulbi-vibrator 50 whose output sets the flip-flop 64. The output of the flip-flop 64 therefore shifts to a digital logic 1 which represents an air/fuel ratio less than stoichiometry. At the time $t_2$ when the sensor output voltage becomes greater than the reference level B, the output of the comparator switch 28 shifts from a low voltage level to a high voltage level to trigger the single-shot multivibrator 56. However, since the flip-flop 64 is in a set state, the output of the multivibrator 56 has no effect.

The control circuit 24 responds to the digital logic 1 output of the flip-flop 64 and begins to increase the air/fuel ratio of the mixture supplied to the engine 10 in ramp fashion toward stoichiometry. When the air/fuel ratio passes through stoichiometry and after the engine transport delay, the output of the oxygen sensor 20 decreases from its positive saturation level to its negative saturation level. The time required for this transition is also determined by the rate of change in the control of the air/fuel ratio by the control circuit 24 and by the time response of the sensor 20. A short time after the transition begins and at time $t_3$, the sensor voltage becomes less than the reference level B and the output of the comparator switch 28 shifts from its high saturation level to its low saturation level resulting in the output of the inverter 58 shifting from a low voltage level to a high voltage level to trigger the single-shot multivibrator 60. The pulse output of the multivibrator 60 resets the flip-flop 54 whose output shifts to a digital logic 0 level representing a sensed air/fuel ratio greater than stoichiometry. At the time $t_4$ when the output voltage of the oxygen sensor 20 becomes less than the reference level A, the output of the comparator switch 26 shifts from its high level to its low level and the output of the inverter 52 shifts from its low level to its high level to trigger the single-shot multivibrator 54. However, since the flip-flop 64 is in its reset state, its output has no effect. The control circuit 24 responds to the low level output of the flip-flop 64 to again decrease the air/fuel ratio of the mixture supplied to the engine 10 toward stoichiometry and the cycle again repeats as previously described and as illustrated in FIG. 3.

The inverter 52 and the single-shot multivibrator 54 function to reset the flip-flop 64 if, after the output voltage of the oxygen sensor 20 becomes greater than the reference level A to set the flip-flop 64, the sensor voltage becomes less than the reference level A without becoming greater than the reference level B. This ensures that the flip-flop indicates an air/fuel ratio greater than stoichiometry any time that the sensor 20 output voltage is less than the reference level A. The single-shot multivibrator 56 functions to set the flip-flop 64 if after, the sensor voltage becomes less than the reference level B to reset the flip-flop 64, the sensor voltage becomes greater than the reference level B without becoming less than the reference level A. In this manner, the flip-flop 64 indicates an air/fuel ratio less than stoichiometry any time that the sensor 20 output voltage is greater than the reference level B.

FIG. 3 illustrates a typical output signal from an oxygen sensor during two cycles of the controller wherein the time response of the sensor is longer when the air/fuel ratio goes from rich to lean through stoichiometry than when the air/fuel ratio goes from lean to rich through stoichiometry. However, the circuit of FIG. 4 functions as previously described to provide an indication of the sense of the deviation of the air/fuel ratio from stoichiometry that is substantially independent of this variance in the time response by switching the output indication of the sense of the deviation at a time substantially close to the time at which the transition is initiated. Further, the output indication of the sense of the deviation of the air/fuel ratio from stoichiometry is made substantially independent of the saturation voltage levels of the sensor by adjusting the reference levels A and B as a function of sensed saturation voltage levels.

The circuit described provides an output signal shifting from a first level to a second level to represent a sensed air/fuel ratio less than stoichiometry at the time when the oxygen sensor signal becomes greater than either the low reference value A (the sensor signal being less than the reference value A prior to that time) or the high reference value B (the sensor signal being less than the reference value B but greater than the reference value A prior to that time) and shifting from the second level to the first level to represent a sensed air/fuel ratio greater than stoichiometry at the time when the oxygen sensor signal becomes less than either the high reference value B (the sensor signal being greater than the reference value B prior to that time) or the low reference value A (the sensor signal being greater than the reference value A but less than the reference value B prior to that time).

The foregoing description of a preferred embodiment for the purpose of illustrating the invention is not to be considered as limiting or restricting the invention, since many modifications may be made by one skilled in the art without departing from the scope of the invention.

The embodiments of the invention in which an exclusive property or privilege is claimed are defined as follows:

1. A fuel control system for an internal combustion engine having combustion space into which an air/fuel mixture is supplied to undergo combustion and having means defining an exhaust passage from the combustion space into which spent combustion gases are discharged and are directed to the atmosphere, comprising, in combination:

a sensor responsive to the oxidizing/reducing conditions in the exhaust passage effective to produce a sensor signal varying between high and low values when the oxidizing/reducing conditions vary through a predetermined oxidizing/reducing condition, the sensor being characterized in that its response to changing oxidizing/reducing conditions in a first direction through the predetermined condition varies from its response to changing oxidizing/reducing conditions in an opposite direction through the predetermined condition;

a sensor signal processor responsive to the sensor signal effective to provide an output signal indicating the sense of deviation of the oxidizing/reducing conditions from the predetermined condition and being substantially independent of said variances in said sensor response characteristics, the sensor signal processor including means responsive to the sensor signal effective to provide the output signal at a first level representing the deviation of the oxidizing/reducing conditions in one sense from the predetermined condition beginning at the time when the value of the sensor voltage signal becomes greater than a first reference value that is less than the high value of the sensor signal and at a second level representing the deviation of the oxidizing/reducing conditions in an opposite sense from the predetermined condition beginning at the time when the value of the sensor signal becomes less than a second reference value that is greater than the low value of the sensor signal; and means responsive to the output signal effective to adjust the air/fuel mixture in a sense tending to restore the predetermined oxidizing/reducing conditions.

2. A fuel control system for an internal combustion engine having combustion space into which an air/fuel mixture is supplied to undergo combustion and having means defining an exhaust passage from the combustion space into which spent combustion gases are discharged and are directed to the atmosphere, comprising, in combination:

a sensor responsive to the oxidizing/reducing conditions in the exhaust passage effective to produce a sensor signal varying between high and low values when the oxidizing/reducing conditions vary through a predetermined oxidizing/reducing condition, the sensor being characterized in that its response to changing oxidizing/reducing conditions in a first direction through the predetermined condition varies from its response to changing oxidizing/reducing conditions in an opposite direction through the predetermined condition;

a sensor signal processor responsive to the sensor signal effective to provide an output signal having first and second levels indicating the sense of deviation of the oxidizing/reducing conditions from the predetermined condition and being substantially independent of said variances in said sensor response characteristics, the sensor signal processor including means responsive to the sensor signal effective to provide the output signal at a first level representing the deviation of the oxidizing/reducing conditions in one sense from the predetermined condition beginning at the time when the value of the sensor voltage signal becomes greater than either of a first or second reference values and ending at the time when the value of the sensor voltage signal becomes less than either of the reference values and at a second level representing the deviation of the oxidizing/reducing conditions in an opposite sense from the predetermined condition beginning at the time when the value of the sensor voltage signal becomes less than either of the reference values and ending at the time when the value of the sensor voltage signal becomes greater than either of the reference values, the first reference value being greater than the low value of the sensor signal and the second reference value being less than the high value of the sensor signal; and means responsive to the output signal effective to adjust the air/fuel mixture in a sense tending to restore the predetermined oxidizing/reducing conditions.

3. A fuel control system for an internal combustion engine having combustion space into which an air/fuel mixture is supplied to undergo combustion and having means defining an exhaust passage from the combustion space into which spent combustion gases are discharged and are directed to the atmosphere, comprising, in combination:

a sensor responsive to the oxidizing/reducing conditions in the exhaust passage effective to produce a sensor signal varying between high and low values when the oxidizing/reducing conditions vary through a predetermined oxidizing/reducing condition, the sensor being characterized in that its response to changing oxidizing/reducing conditions in a first direction through the predetermined condition varies from its response to changing oxidizing/reducing conditions in an opposite direction through the predetermined condition;

a sensor signal processor responsive to the sensor signal effective to provide an output signal indicating the sense of deviation of the oxidizing/reducing conditions from the predetermined condition and being substantially independent of said variances in said sensor response characteristics, the sensor signal processor including means effective to detect the minimum value of the sensor signal, means effective to provide a first reference signal having a value greater than the detected minimum value of the sensor signal by a first predetermined offset amount, means effective to detect the peak value of the sensor signal, means effective to provide a second reference signal having a value less than the detected peak value of the sensor signal by a second predetermined offset amount, and means responsive to the sensor signal and the first and second reference signals effective to provide the output signal at a first level representing the deviation of the oxidizing/reducing conditions in one sense from the predetermined condition beginning at the time when the value of the sensor voltage signal becomes greater than the value of either of the first or second reference signals and ending at the time when the value of the sensor voltage signal becomes less than the value of either of the reference signals and at a second level representing the deviation of the oxidizing/reducing conditions in an opposite sense from the predetermined condition beginning at the time when the value of the sensor voltage signal becomes less than the value of either of the reference signals and ending at the time when the value of the sensor voltage signal becomes greater than the value of either of the reference signals; and means responsive to the output signal effective to adjust the air/fuel mixture in a sense tending to restore the predetermined oxidizing/reducing conditions.

* * * * *